US010022030B2

(12) United States Patent
Rueckheim et al.

(10) Patent No.: US 10,022,030 B2
(45) Date of Patent: Jul. 17, 2018

(54) MOVABLE DEVICE

(71) Applicant: Carl Freudenberg KG, Weinheim (DE)

(72) Inventors: Markus Rueckheim, Griesheim (DE); Christian Mast, Mannheim (DE)

(73) Assignee: Carl Freudenberg KG, Weinheim (DE)

( * ) Notice: Subject to any disclaimer, the term of this patent is extended or adjusted under 35 U.S.C. 154(b) by 0 days.

(21) Appl. No.: 15/311,523

(22) PCT Filed: Jun. 19, 2015

(86) PCT No.: PCT/EP2015/063871

§ 371 (c)(1),
(2) Date: Nov. 16, 2016

(87) PCT Pub. No.: WO2016/005171

PCT Pub. Date: Jan. 14, 2016

(65) Prior Publication Data

US 2017/0079500 A1 Mar. 23, 2017

(30) Foreign Application Priority Data

Jul. 7, 2014 (DE) ..... 10 2014 009 963

(51) Int. Cl.
*A47L 11/40* (2006.01)
*A47L 9/00* (2006.01)

(52) U.S. Cl.
CPC ..... *A47L 11/4058* (2013.01); *A47L 9/009* (2013.01); *A47L 11/4011* (2013.01); *A47L 11/4041* (2013.01); *A47L 11/4061* (2013.01); *A47L 2201/00* (2013.01); *A47L 2201/04* (2013.01)

(58) Field of Classification Search
CPC ..... A47L 11/4058; A47L 9/009; A47L 9/114011; A47L 11/4041; A47L 11/4061; A47L 2201/00; A47L 2201/04
See application file for complete search history.

(56) References Cited

U.S. PATENT DOCUMENTS

| | | | | |
|---|---|---|---|---|
| 5,293,955 | A * | 3/1994 | Lee | A47L 11/4061 15/319 |
| 8,742,926 | B2 * | 6/2014 | Schnittman | A47L 9/106 15/319 |
| 9,675,222 | B2 * | 6/2017 | Shin | A47L 9/009 |
| 2004/0049877 | A1 * | 3/2004 | Jones | A47L 5/30 15/319 |

(Continued)

FOREIGN PATENT DOCUMENTS

| | | | |
|---|---|---|---|
| DE | 102010011845 | A1 | 9/2011 |
| EP | 2730204 | A1 | 5/2014 |
| EP | 2897016 | A2 | 7/2015 |

*Primary Examiner* — Dung Van Nguyen
(74) *Attorney, Agent, or Firm* — Leydig, Voit & Mayer, Ltd.

(57) ABSTRACT

A movable device has a base which can be moved on a surface using a travel gear, which may improve and design a movable device such that it can be moved on a surface without major damages and in a trouble-free manner, wherein the base is associated with one or more detectors configured to detect obstacles and/or with dampers configured to damp impact and/or with carriers configured to carry along particles.

16 Claims, 4 Drawing Sheets

(56) References Cited

U.S. PATENT DOCUMENTS

| | | | | |
|---|---|---|---|---|
| 2008/0276407 | A1* | 11/2008 | Schnittman | A47L 11/34 15/319 |
| 2013/0007971 | A1 | 1/2013 | Juergens et al. | |
| 2016/0073840 | A1* | 3/2016 | Haegermarck | A47L 9/00 15/340.3 |
| 2016/0309975 | A1* | 10/2016 | Lindhe | A47L 9/2805 |
| 2017/0181591 | A1* | 6/2017 | Tanaka | A47L 9/2805 |

* cited by examiner

MOVABLE DEVICE

CROSS-REFERENCE TO RELATED APPLICATIONS

This application is a U.S. national stage application under 35 U.S.C. § 371 of International Application No. PCT/EP2015/063871, filed on Jun. 19, 2015, and claims benefit to German Patent Application No. DE 10 2014 009 963.6, filed on Jul. 7, 2014. The International Application was published in German on Jan. 14, 2016, as WO 2016/005171 A1 under PCT Article 21(2).

FIELD

The invention relates to a movable device comprising a main body that can be moved on a surface using a running gear.

BACKGROUND

Self-moving cleaning robots are known from the prior art, in particular from DE 10 2010 011 845 A1.

These movable devices can, however, be disrupted by electronic equipment cables when moving. The cables may be drawn into the running gear of the devices such that said device is no longer able to proceed properly.

Similar problems can arise when a device of this type comes into contact with the tassels of a rug.

Furthermore, a movable device may undesirably collide with walls or objects, as a result of which the device may sustain damage.

SUMMARY

An aspect of the invention provides a movable device, comprising: a main body that can be moved on a surface using a running gear, wherein the main body includes a unit configured to detect obstacles and/or configured to damp collisions and/or configured to pick up particles.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1:
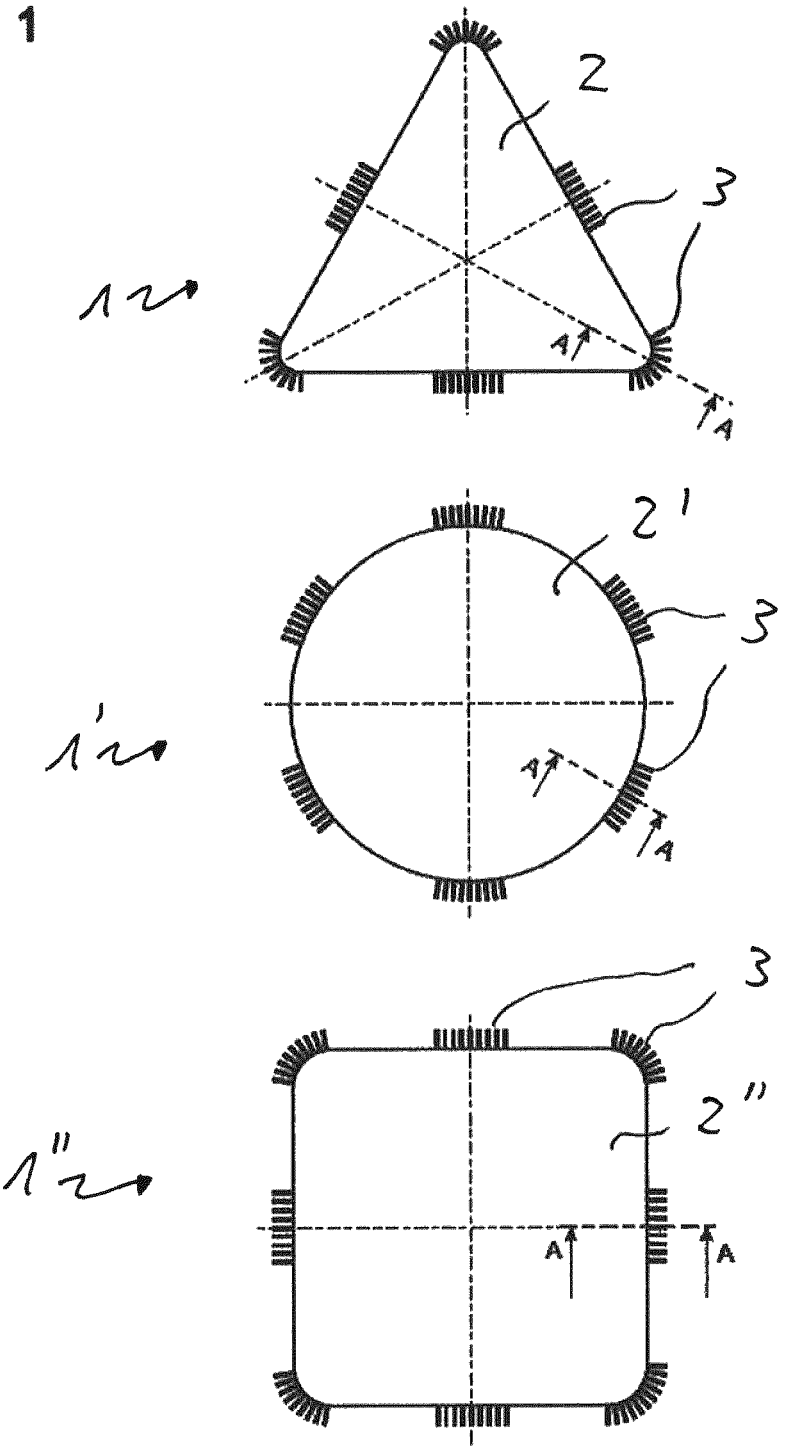
FIG. 1 a number of plan views of three differently formed devices, a triangular device being shown in the view at the top, a circular device being shown in the view in the middle, and a square device being shown in the view at the bottom.

In view of the above, an aspect of the invention designs and develops a movable device of the type mentioned at the outset such that the device can move on a surface with as little damage and disruption as possible.

According to an aspect of the invention, it has been found that means for detecting obstacles and/or means for damping collisions prevent objects such as cables from being drawn into the running gear of the device. It has further been found that means for damping collisions prevent the device from colliding with walls and thus sustaining damage. Finally, it has been found that means for picking up particles can produce a wiping effect in particulars in corners, as a result of which particles are swept out of the corners. It has also been found that the same means can fulfill all the aforementioned functions simultaneously. In this respect, a movable device is provided that can move on a surface with as little damage and disruption as possible.

Consequently, the problem mentioned at the outset is solved.

The means can form an open-worked or comb-like structure. Dirt particles can thus pass through the means and reach a cleaning apparatus. Cables or other objects are held off and cannot reach the running gear. Rather, cables are pushed along by the device and not drawn in. Rug tassels are not drawn in either.

The means can be arranged on the main body in a height-adjustable manner. The device can thus be adjusted such that it can be moved on relatively uneven tiles having gaps. The sensitivity of the device to obstacles to be heeded can thus advantageously be adjusted. Allowance can therefore be made for plinths, ledges or the edges of rugs.

A means can be guided in a guide in a height-adjustable manner. It is thus ensured that a means can be easily inserted into the guide and moved therein. Preferably, the guide is designed to have an undercut such that the means cannot be withdrawn from the guide in the lateral direction. With this in mind, it is conceivable to design the guide as a dovetail guide.

The means could be designed as strips that protrude from the main body. Strips can easily be deformed and are designed to be planar and lamellar. They can thus perform a wiping effect in corners in particular. The strips guide dirt particles in such a way that they can be taken up by a cleaning device, such as a brush or roller.

The strips can be made from an elastomer. This means that said strips are easily flexibly deformed and provide good protection from collisions. The strips can be easily deflected, in particular in corners.

Each means, in particular a strip, can be linked to the main body by means of a living hinge. Little noise is therefore made when the device collides with an obstacle. A living hinge forms a specified bending point, at which the means or the strip can be particularly easily deflected.

The device can comprise at least one cleaning apparatus for cleaning a surface. The device can therefore be used as a cleaning robot.

The cleaning apparatus can be designed as a brush or a roller. Brushes or rollers are easily rotated and can, at the same time, be used as the running gear.

Different cleaning apparatuses can be arranged in various positions or on various sides of the main body. Coarse dirt, such as bread crumbs or hair, can thus be taken up on one side, while finer dirt, such as dust for example, is taken up on another side.

The device can comprise a movement apparatus that moves the device independently. The device can therefore move independently on a surface for a certain period without a user having to constantly interact therewith.

FIG. 1 shows three movable devices 1, 1', 1", each comprising a main body 2, 2', 2" which can be moved on a surface by means of a running gear.

Means 3 for detecting obstacles, damping collisions and picking up particles are associated with each main body 2, 2', 2". The means 3 are arranged in individual conglomerates but may also be arranged individually on or all around the respective main body 2, 2', 2".

The means 3 form an open-worked or comb-like structure.

Figure 2:
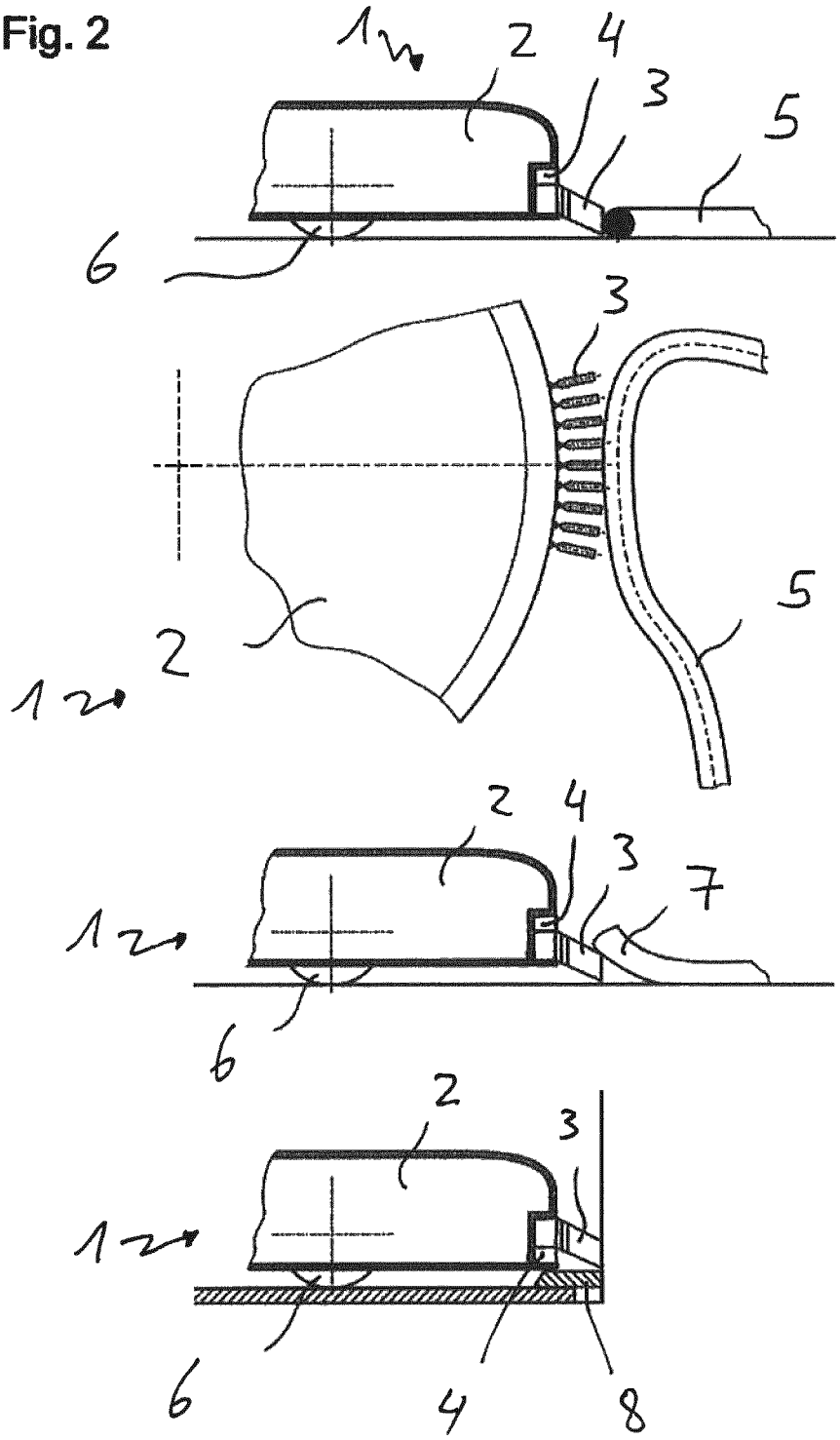
FIG. 2 a side view of a device colliding with a cable in the view at the very top, a plan view of said device in the second view, a side view of the device colliding with a rug edge in the third view from the top, and a side view of the device having height-adjustable means in the view at the very bottom.
Figure 4:
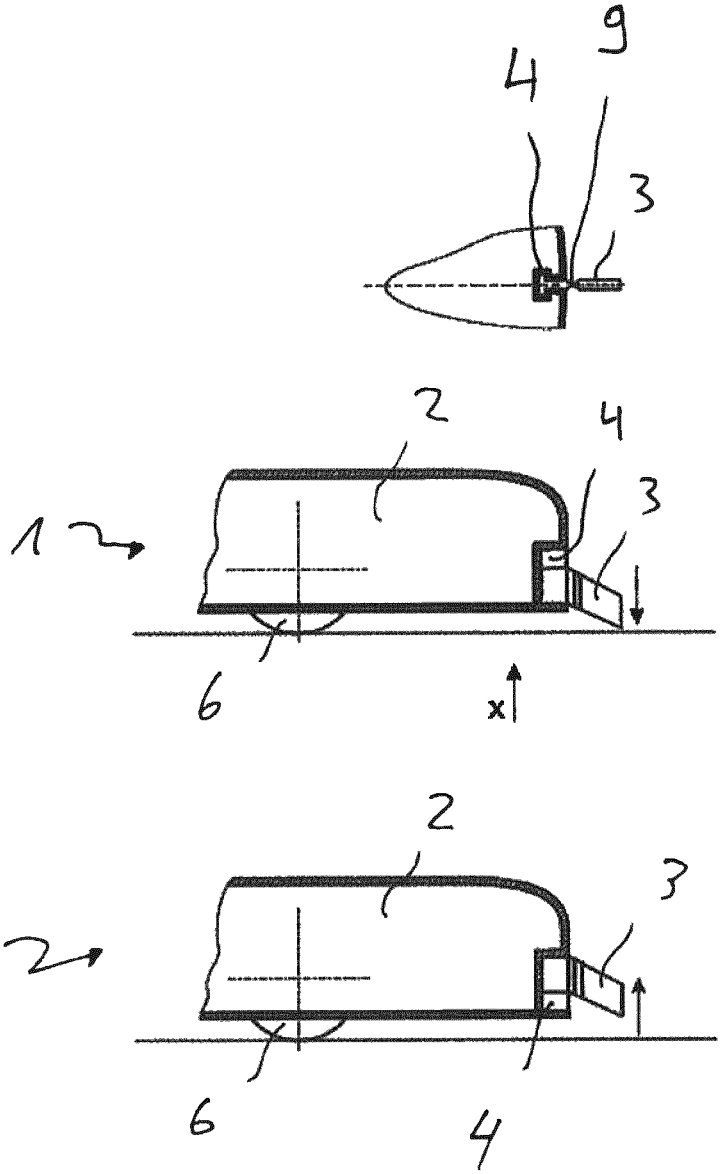
FIG. 4 a plan of view of a dovetail guide for a means in the view at the top, and shows a device in which the means is on the lower stop in the view in the middle and a device in which the means is on the upper stop in the third view.

The two views at the bottom of each of FIG. 2 and FIG. 4 show that the means 3 are arranged in a height-adjustable manner on the main body 2. A means 3 is guided in a guide 4 in a height-adjustable manner. The means 3 are designed as strips that protrude from the main body 2. The view at the very top of FIG. 4 further shows that the guide 4 is designed as a guide having an undercut.

The two views at the top of FIG. 2 show a cable 5 being pushed along by the strips and not being drawn into the running gear or into a cleaning apparatus 6.

In the third view from the top of FIG. 2, a strip is on the lower stop and therefore collides with a rug edge 7 such that it cannot be driven over or drawn in. In the fourth view from the top of FIG. 2, the strip is on the upper stop and therefore allows a tile 8 to be driven over.

Figure 3:
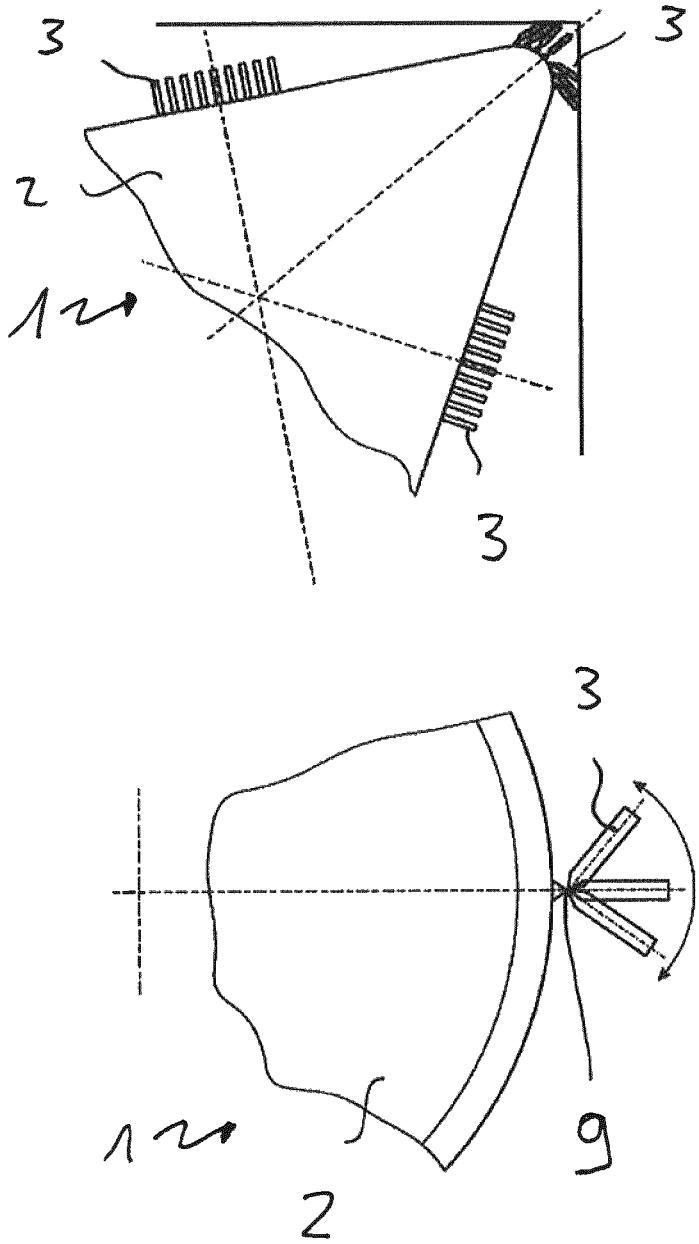
FIG. 3 a triangular device colliding with a corner and performing a wiping effect in the view at the top, and is a plan view of the device in the view at the bottom, the movement of a strip being shown.

The view at the bottom of FIG. 3 shows each means 3 linked to the main body 2 by means of a living hinge 9. The view at the top of FIG. 3 shows that the means 3 can be deflected particularly easily in a corner and thus produces a wiping effect. The means 3 or the strips can sweep dirt particles out of the corner.

FIG. 4 shows that the device 1 comprises at least one cleaning apparatus 6 for cleaning a surface. The cleaning apparatus 6 is designed as a rotatable brush or roller.

The devices 1, 1', 1" shown in FIG. 1 to FIG. 4 comprise a movement apparatus (not shown) that moves the device 1, 1', 1" independently. The movement apparatus can comprise the cleaning apparatus 6 as the running gear.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B, and C" should be interpreted as one or more of a group of elements consisting of A, B, and C, and should not be interpreted as requiring at least one of each of the listed elements A, B, and C, regardless of whether A, B, and C are related as categories or otherwise. Moreover, the recitation of "A, B, and/or C" or "at least one of A, B, or C" should be interpreted as including any singular entity from the listed elements, e.g., A, any subset from the listed elements, e.g., A and B, or the entire list of elements A, B, and C.

The invention claimed is:

1. A movable device, comprising:

a main body that can be moved on a surface using a running gear, wherein the main body includes a unit configured to detect obstacles and/or configured to damp collisions and/or configured to pick up particles, wherein the unit forms a comb-shaped structure, and wherein the unit includes strips that protrude from the main body.

2. The device of claim 1, wherein the unit arranged on the main body in a height-adjustable manner.

3. The device of claim 2, wherein the unit is guided in a guide in a height-adjustable manner.

4. The device of claim 1, wherein the unit is linked to the main body using a living hinge.

5. The device of claim 1, further comprising:

a cleaning apparatus configured to clean a surface.

6. The device of claim 5, wherein the cleaning apparatus is a brush or roller.

7. The device of claim 5, wherein the cleaning apparatus includes a brush.

8. The device of claim 5, wherein the cleaning apparatus includes a roller.

9. The device of claim 1, further comprising:

a first and a second cleaning apparatus, configured to clean a surface, wherein the cleaning apparatuses are different and are arranged in various positions of or on various sides of the main body.

10. The device of claim 1, further comprising:

a movement apparatus configured to move the device independently.

11. The device of claim 1, wherein the main body includes the unit configured to detect obstacles.

12. The device of claim 1, wherein the main body includes more than one of the unit configured to detect obstacles.

13. The device of claim 1, wherein the main body includes the unit configured to damp collisions.

14. The device of claim 1, wherein the main body includes more than one of the unit configured to damp collisions.

15. The device of claim 1, wherein the main body includes the unit configured to pick up particles.

16. The device of claim 1, wherein the main body includes more than one of the unit configured to pick up particles.

* * * * *